US005620338A

United States Patent [19]

Stephens et al.

[11] Patent Number: 5,620,338

[45] Date of Patent: Apr. 15, 1997

[54] UNIVERSAL BATTERY CABLE ASSEMBLY

[75] Inventors: Jan Stephens, Vashon; Ron Decoteau, Carnation; Alan Martin, Issaquah; Steve Bleistein, Lake Forest Park, all of Wash.

[73] Assignee: PACCAR Inc., Bellevue, Wash.

[21] Appl. No.: 295,985

[22] Filed: Aug. 25, 1994

[51] Int. Cl.[6] ..... H01R 13/52

[52] U.S. Cl. ..... 439/522; 439/766

[58] Field of Search ..... 439/504, 522

[56] References Cited

U.S. PATENT DOCUMENTS

| | | | |
|---|---|---|---|
| D. 303,108 | 8/1989 | Julian et al. | D13/120 |
| 1,225,297 | 5/1917 | Willard | 439/760 |
| 1,225,298 | 5/1917 | Willard | 439/760 |
| 1,292,247 | 1/1919 | Busch | 439/762 |
| 1,704,336 | 3/1929 | Parson et al. | 439/388 |
| 2,041,966 | 5/1936 | Schaefer | 439/522 |
| 2,110,055 | 3/1938 | Richter | 439/522 |
| 2,274,437 | 2/1942 | St. George | 439/757 |
| 2,341,748 | 2/1944 | Webb | 439/756 |
| 2,399,836 | 5/1946 | Taylor | 439/762 |
| 2,675,532 | 4/1954 | Quick | 439/756 |
| 2,789,274 | 4/1957 | Zam | 439/522 |
| 2,844,806 | 7/1958 | McKissick | 439/522 |
| 2,903,672 | 9/1959 | Ade | 439/766 |
| 3,002,173 | 9/1961 | Allen | 439/431 |
| 3,369,215 | 2/1968 | Haegert | 439/764 |
| 3,389,368 | 6/1968 | Schaefer | 439/522 |
| 3,407,382 | 10/1968 | Haegert | 439/763 |
| 3,605,065 | 9/1971 | Shannon | 439/504 |
| 3,609,656 | 9/1971 | Breidegarn, Jr. | 439/764 |
| 3,829,823 | 8/1974 | Dumesnil | 439/522 |
| 3,928,079 | 12/1975 | Jennings et al. | 429/179 |
| 4,033,664 | 7/1977 | Norman | 439/388 |
| 4,049,335 | 9/1977 | Julian et al. | 439/892 |
| 4,118,097 | 10/1978 | Budnick | 439/387 |
| 4,126,367 | 11/1978 | Miller | 439/504 |
| 4,288,504 | 9/1981 | Julian et al. | 429/179 |
| 4,325,760 | 4/1982 | Julian et al. | 156/49 |
| 4,420,213 | 12/1983 | Julian et al. | 439/522 |
| 4,473,264 | 9/1984 | Julian et al. | 439/135 |
| 4,483,910 | 11/1984 | Julian | 429/179 |
| 4,932,896 | 6/1990 | Julian | 439/504 |
| 4,934,958 | 6/1990 | Julian | 439/504 |
| 5,106,319 | 4/1992 | Julian | 439/224 |
| 5,145,421 | 9/1992 | Julian | 439/801 |
| 5,301,907 | 4/1994 | Julian | 248/74.1 |
| 5,346,782 | 9/1994 | Julian | 429/65 |

*Primary Examiner*—Neil Abrams
*Assistant Examiner*—Barry Matthew L. Standig
*Attorney, Agent, or Firm*—Seed and Berry LLP

[57] ABSTRACT

A method and apparatus for providing a universal battery cable assembly is shown and described. In a preferred embodiment, a battery terminal and a conductive spacer are seated in a mold and encased in a quantity of insulating, resilient material that cures to form a boot of uniform size and shape, regardless of whether the battery cable assembly will function as a top terminal or as a bottom terminal, and regardless of the number and sizes of conductors that may be coupled to the battery terminal. A battery cable assembly provided in accordance with the present invention has a repeating geometry that allows it to be stacked on and sealingly engage a second battery cable assembly having the same structure.

11 Claims, 4 Drawing Sheets

UNIVERSAL BATTERY CABLE ASSEMBLY

TECHNICAL FIELD

This invention relates to battery cable terminals, and more particularly, to a method and apparatus for providing a universal battery cable assembly.

1. Background of the Invention

Large vehicles, for example, trucks, commonly use multiple batteries. In order to connect two or more batteries together, it is desirable to use battery cables having terminals that may be stacked on one another.

Currently available systems provide battery cable terminals that are either a dedicated top terminal or a dedicated bottom terminal, that are stacked and secured to a battery post or stud by a nut. Although currently available systems provide a reasonably good connection, they have a limited life span, due to the corrosive effects of the environment and typical working conditions. It is also necessary to have different tooling to create different configurations of battery terminals, resulting in increased manufacturing complexity and cost.

2. Summary of the Invention

It is therefore an object of this invention to provide an improved battery cable assembly.

It is another object of this invention to provide a battery cable assembly that will resist corrosive environmental effects and therefore have a longer life than currently available systems.

It is another object of this invention to provide a simplified method for manufacturing battery cable assemblies.

These and other objects of the invention, as will be apparent herein, are accomplished by providing a molded battery cable terminal that has a uniform size and shape. In a preferred embodiment of the present invention, a terminal having a tang and a barrel, the barrel being coupled to a battery cable or conductor, is placed in a mold. The tang is provided with an aperture to receive a battery post; therefore, the tang is placed on a pin within the mold, the pin passing through the aperture of the tang.

A conductive, ring-like spacer having a hole extending through the spacer is placed on the pin in the mold, such that the spacer is seated on the tang. An insulating, resilient material is injected into the mold, thereby encasing the terminal and an outer surface of the spacer in a boot of insulating material.

When the boot of insulating, resilient material is cured, the spacer may be left in place, such that the battery cable assembly will function as a bottom terminal, or removed, such that the battery cable assembly will function as a top terminal, as discussed below. The boot has a uniform shape and size regardless of whether it will function as part of a top or bottom terminal. The battery cable assembly provided in accordance with the present invention is therefore universal in that it may function as a top or bottom terminal, thereby eliminating the need for different tooling. The spacer is provided with an annular groove in its outer surface, such that when the spacer is removed, an annular opening is created in the boot, the opening having an inner wall and a bead protruding from the inner wall the bead being created by the annular groove of the spacer.

A standard tang is used, regardless of whether the barrel is to accommodate one or more conductors. In a preferred embodiment, the barrel is coupled to a conductor by crimping,such that the barrel substantially conforms to an outer dimension of the conductor. If it is desirable to have two conductors coupled to a terminal, the barrel is crimped around the conductors in an hourglass shape, such that the barrel substantially conforms to an outer dimension of each of the conductors. If a conductor is considerably smaller than the barrel, a copper sleeve may be placed in the barrel prior to crimping it onto the conductor.

The boot of insulating, resilient material also has a uniform shape and size regardless of the number and size of conductors coupled to the terminal. In order to seal the conductor and terminal against the corrosive effects of the environment, a portion of the conductor adjacent the terminal is also encased within the boot. In a preferred embodiment, the conductor is encased in a thermal plastic insulating material that will bind to the insulating, resilient material of the boot. If two conductors are coupled to the terminal, a portion of each conductor adjacent the terminal is encased in the insulating, resilient material, such that the insulating, resilient material surrounds each of the conductors and a quantity of the material separates the conductors.

In a preferred embodiment, a boot provided in the manner described above has a repeating geometry that allows it to be stacked on another boot having the same configuration. More particularly, the annular opening created by the spacer is surrounded by a raised member that is dimensioned to mimic a chamfered edge of a battery pad. A bottom surface of the boot is provided with an annular opening aligned with the aperture in the tang, the opening in the bottom of the boot having a larger diameter than a diameter of the tang aperture, such that a portion of the tang is exposed. The annular opening in the bottom surface of the boot has a wall dimensioned to sealingly engage the edge of a battery pad and to therefore also sealingly engage the raised member in the top surface of the boot.

Therefore, in accordance with a preferred embodiment of the present invention, a battery terminal encased in a boot as described above may be placed on a battery post, the wall of the annular opening in the bottom surface of the boot sealingly engaging the edge of a battery pad. A second boot may then be stacked on top of the first boot, the annular opening in the bottom surface of the top terminal sealingly engaging the raised member of the top surface of the bottom terminal, the spacer in the bottom terminal acting as a conductor of electricity between the two terminals. By removing the spacer from the top terminal, a hex nut may be screwed onto the battery post to secure the top and bottom terminals to each other and to the battery pad, an outer edge of the nut being sealingly engaged by the annular bead provided on the inner wall of the annular opening of the top terminal.

In a preferred embodiment, a cap made of an insulating, resilient material may be placed over the stacked assembly, the cap being configured to have an interference fit with the hex nut and sealingly engaging the raised member of the top terminal. The use of such a cap will ensure that inadvertent contact between the nut and conductive elements is avoided.

DETAILED DESCRIPTION OF THE INVENTION

When a large vehicle, such as a truck, requires the use of multiple batteries, it is desirable to use battery cables having terminals that may be stacked on one another, to connect two or more batteries together. Currently available systems have several disadvantages, however, for example, they allow water and other corrosive elements to enter the battery cable assembly, thereby reducing the useful life of the battery cable assemblies. Also, different tooling is required to produce cable assemblies of different configurations. These problems, among others, are reduced by providing a battery cable assembly in accordance with the present invention.

Figure 1:
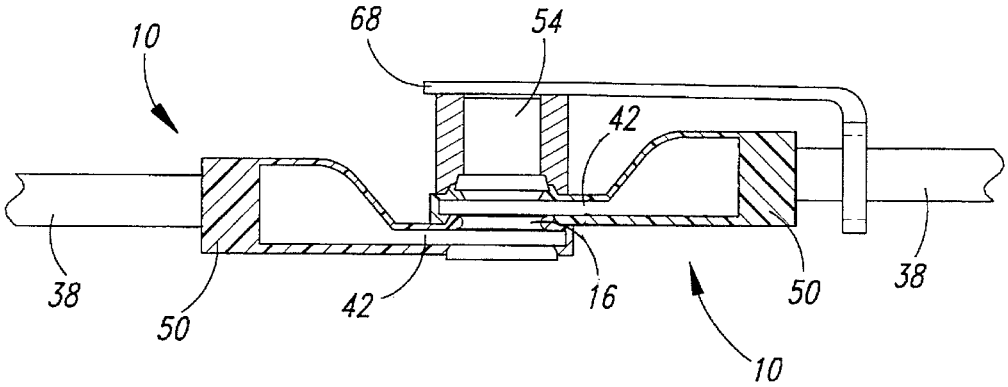
FIG. 1 is a from elevational view of battery cable assemblies stacked on a battery post in accordance with a preferred embodiment of the present invention.
Figure 2:
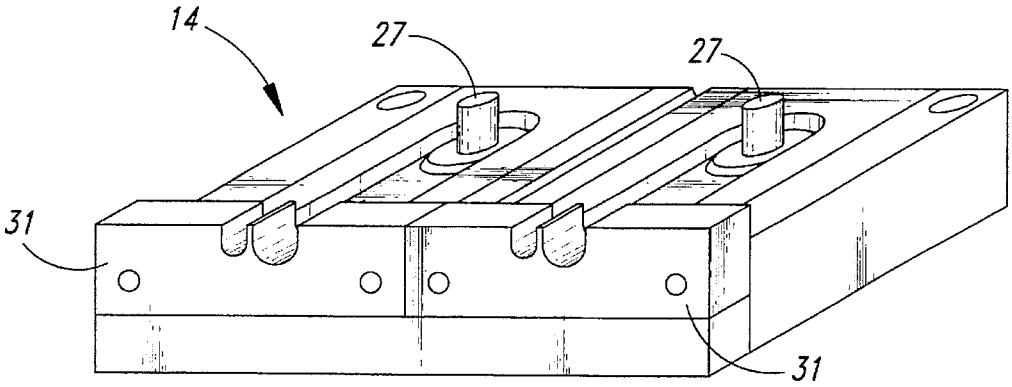
FIG. 2 is a front isometric view of a mold used in accordance with a preferred embodiment of the present invention.
Figure 3:
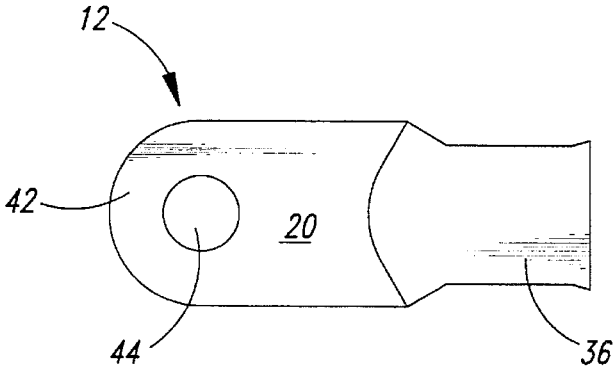
FIG. 3 is a top plan view of a terminal used in a preferred embodiment of the present invention.
Figure 4:
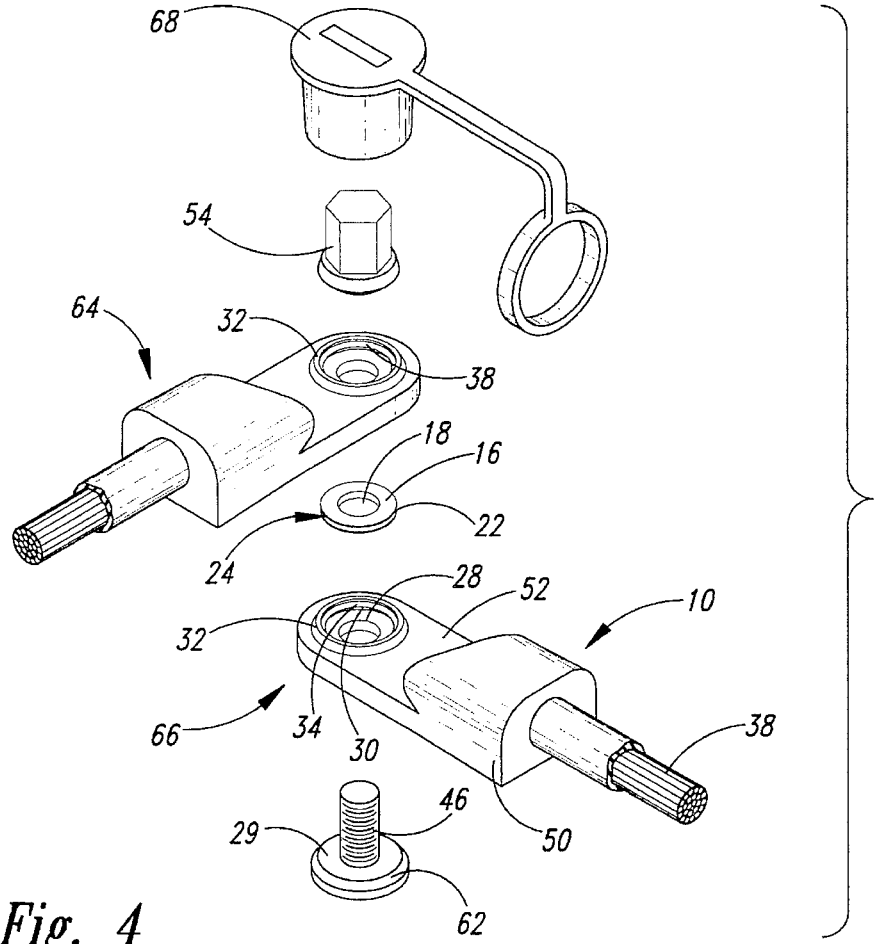
FIG. 4 is an exploded isometric view of the battery cable assemblies of FIG. 1.

FIGS. 1 and 4 illustrate two battery cable assemblies 10 provided in accordance with a preferred embodiment of the present invention, stacked on a post 46 of a battery. A molded battery cable terminal 50 is provided, having a uniform size and shape, regardless of whether it will function as a top terminal or as a bottom terminal, and regardless of the number and size of conductors 38 in the battery cable assembly. This is accomplished by providing a mold 14 and pin 27, as illustrated in FIG. 2. (It will be understood that only a bottom half of mold 14 is shown in FIG. 2, the mold being configured to form two cable assemblies simultaneously.) A terminal 12 having a tang 42 and barrel 36, as illustrated in FIG. 3, is placed in the mold. The tang 42 is provided with an aperture 44 to accommodate the battery post or stud 46. Aperture 44 is therefore placed over pin 27 of mold 14. The barrel 36 of terminal 12 is coupled to a conductor 38. Although this may be accomplished in a variety of ways, in a preferred embodiment, barrel 36 is crimped onto conductor 38.

A conductive, ring-like spacer 16 having a hole 18 extending through the spacer, is placed on pin 27, such that spacer 16 is seated on a top surface 20 of tang 42. Mold 14 is then closed, and a quantity of insulating, resilient material, such as polyvinylchloride (PVC), is injected into the mold, thereby encasing the terminal 12 and an outer surface 24 of spacer 16, such that the insulating, resilient material is substantially flush with a top surface of spacer 16. When the insulating, resilient material is cured, and mold 14 is removed, the terminal 12 and spacer 16 are encased in a boot 50, having a uniform shape and size.

Figure 5:
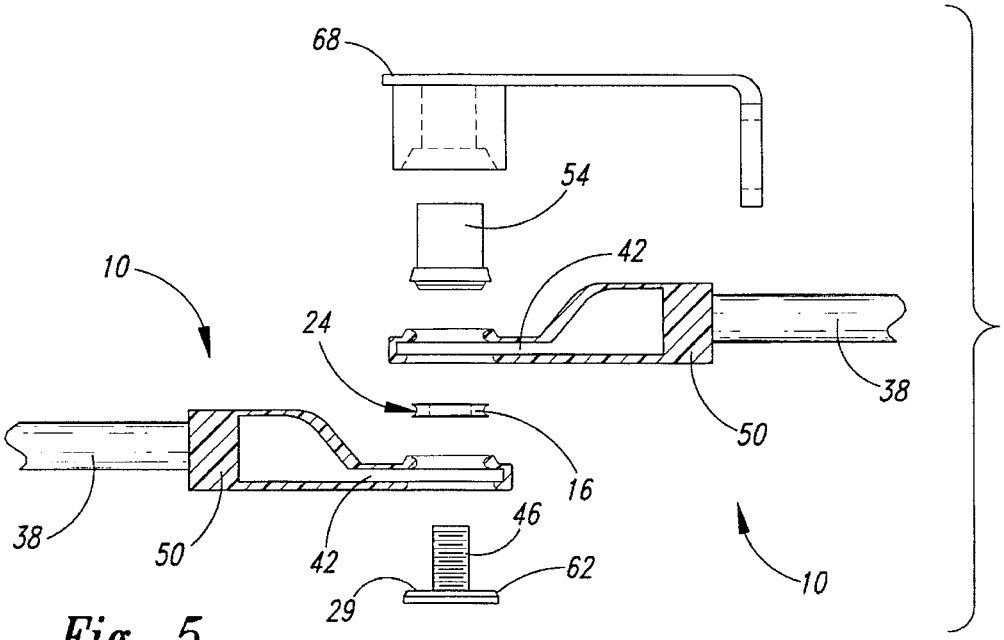
FIG. 5 is an exploded front elevational view of the battery cable assemblies of FIG. 1.

Spacer 16 may be either removed from boot 50, or left in place. If it is left in place, the battery cable assembly 10 will function as a bottom terminal 66, as illustrated in FIGS. 4 and 5 and discussed in greater detail below. Alternatively, if spacer 16 is removed from boot 50, the batten? cable assembly 10 will function as a top terminal 64, as further illustrated in FIGS. 4 and 5. A universal battery cable assembly may therefore be accomplished in accordance with the present invention by using a universal terminal and a universal mold, where only a wire seal or back panel 31 of the mold must be changed to accommodate different numbers and sizes of conductors. The use of universal tooling therefore simplifies the manufacturing process.

As can also be seen from FIG. 4, spacer 16 is provided with annular groove 22 in its outer surface 24, outer surface 24 comprising the circumference of the spacer between a top surface and bottom surface of the spacer. When spacer 16 is removed from boot 50, an annular opening 28 is created in the boot, the annular opening 28 having an inner wall 30 and an annular bead 34 protruding from inner wall 30, the annular bead 34 being created by the injection of insulating, resilient material into the annular groove 22 of spacer 16. Annular bead 34 therefore serves to capture spacer 16 in a bottom terminal 66, and to sealingly engage a nut 54 when two battery cable assemblies are stacked, as discussed in greater detail below.

In a preferred embodiment of the present invention, as illustrated in FIG. 3, a standard tang 42 is used, regardless of the number and size of conductors 38 to be coupled to tang 42. In a preferred embodiment, barrel 36 is crimped onto conductor 38, such that barrel 36 substantially conforms to an outer dimension of the conductor. If two conductors are to be coupled to tang 42, for example to provide one conductor between batteries and a second from one of the batteries to an accessory, the barrel 36 is crimped around the two conductors 38 in an hourglass shape, such that the barrel 36 substantially conforms to an outer dimension of each of the conductors. If a conductor is considerably smaller than the barrel, a copper sleeve may be placed in the barrel prior to crimping it onto the conductor.

In order to seal the battery cable assembly and prevent water and other corrosive elements from entering the battery cable assembly, a portion of the conductor 38 adjacent terminal 12 is also encased within the boot 50 of insulating, resilient material. In a preferred embodiment, conductor 38 is encased in a general purpose thermal plastic insulating material 26 and the boot is made of PVC, such that the two materials bind and seal the battery cable assembly against moisture.

Figure 6:
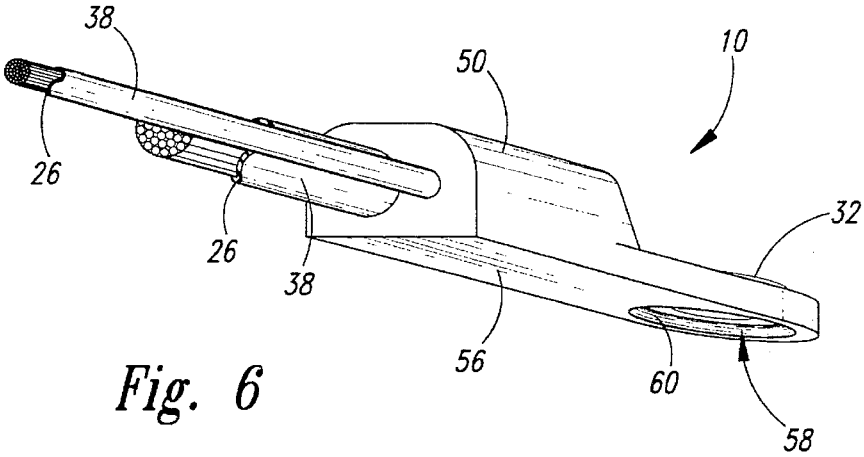
FIG. 6 is a rear isometric view of a preferred embodiment of the present invention.
Figure 7:
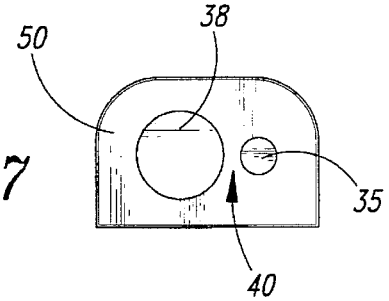
FIG. 7 is a rear elevational view of the battery cable assembly of FIG. 5.

If two conductors are coupled to terminal 12, as illustrated in FIG. 6, a portion of each conductor adjacent the terminal is encased in the insulating, resilient material. To ensure a secure seal, a portion of insulating, resilient material separates the two conductors 38, as illustrated in a region identified by reference numeral 40 of FIG. 7, such that insulating, resilient material surrounds the entire circumference of each conductor 38.

In a preferred embodiment, a battery cable assembly 10 provided in accordance with the present invention has a repeating geometry that allows it to be stacked on another boot having the same configuration. As best seen in FIG. 4, a raised member 32 surrounds the annular opening 28 created by spacer 16. The raised member 32 is therefore located on a top surface 52 of boot 50, and the raised member 32 is dimensioned to have the same configuration as a chamfered edge 62 of a battery pad 29. Most battery pads have a standard configuration, and will therefore work in combination with the battery cable assemblies of the present invention.

Figure 8:
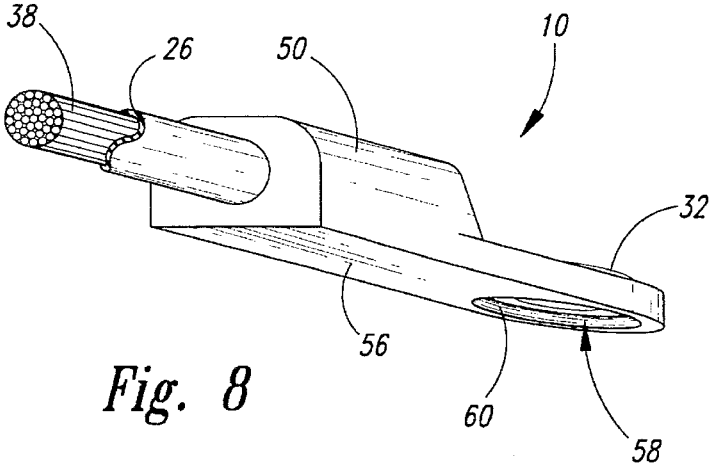
FIG. 8 is a rear isometric view of an alternative embodiment of the present invention.
Figure 9:
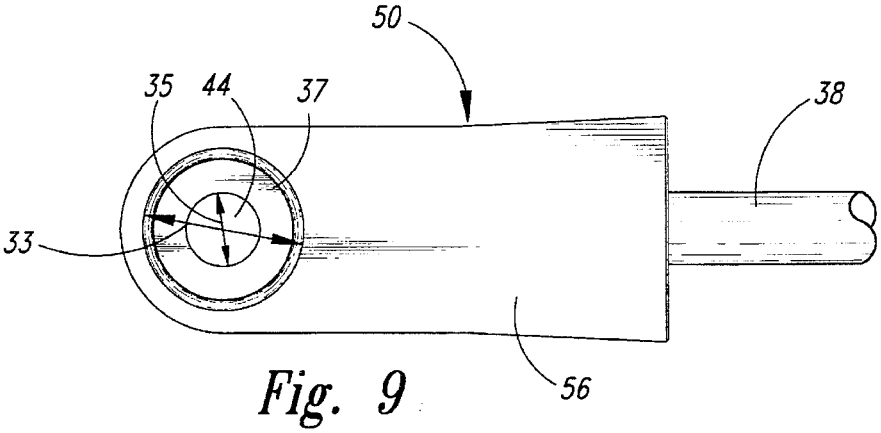
FIG. 9 is a bottom plan view of the battery cable assembly of FIG. 8.

As illustrated in FIGS. 6, 8 and 9, a bottom surface 56 of boot 50 is provided with an annular opening 58 that is aligned with aperture 44 of tang 42. The diameter 33 of the annular opening 58 is larger than the diameter 35 of aperture 44 such that an annular portion 37 of tang 42 is exposed. In a preferred embodiment, a wall 60 of the annular opening 58 is convex and therefore will sealingly engage the chamfered edge 62 of a battery pad 29, and also sealingly engage the raised member 32 of boot 50.

Therefore, in accordance with a preferred embodiment, a battery terminal encased in a boot having a structure as described above, may be placed on a battery post 46, wall 60 of annular opening 58 thereby sealingly engaging edge 62 of a battery pad. Spacer 16 is left within boot 50, and the battery cable assembly therefore functions as a bottom terminal 66. A second battery cable assembly may then be placed on post 46 in a stacked position relative to the bottom terminal, the second battery cable assembly acting as a top terminal 64. Wall 60 of the annular opening 58 in bottom surface 56 of the top terminal 64 sealingly engages raised member 32 of bottom terminal 66, and spacer 16 contained in bottom terminal 66 acts as a conductor of electricity between the tangs 42 of the respective terminals.

By removing spacer 16 from top terminal 64, a nut 54 may be screwed onto post 46, to secure the two terminals to each other and to the battery. Nut 54 is dimensioned to sealingly engage the annular bead 34 protruding from inner wall 30 of the annular opening 28 of top terminal 64.

By providing battery cable assemblies 10 in accordance with the present invention, and by stacking them as described above, a securely sealed contact with the battery is achieved, that is superior to currently available systems. The superiority of the seal achieved in accordance with the present invention was illustrated in a test conducted by applicant, wherein five types of battery cables, including cables provided in accordance with the invention, were subjected to alternating periods of being exposed to a corrosive environment and being allowed to air dry and cool to ambient temperature. In particular, the samples were bolted to a battery post and placed in a Bemco model SS30XLS corrosion chamber where they were exposed to a mixture of 5% salt (NaCl), 0.05% sodium bisulfate ($NaHSO_3$), and 94.95% water. While in this environment, the samples were subjected to a 25.0 A current. The presence of salt, sulfur, and an electric current in the cables was intended to replicate the corrosive environment of a battery box. After 500 hours of corrosion testing, the samples were unbolted and observed. The cables provided in accordance with the present invention were the only ones tested to show no signs of environmental leakage and resulting corrosion. All of the other samples showed green and black corrosion deposits or other signs of physical degradation.

Although battery cables provided in accordance with the present invention create a tight seal, a cap 68 made of insulating, resilient material, such as PVC, may be placed over the stacked assembly. The cap 68 is configured to have an interference fit with hex nut 54 and to sealingly engage the raised member 32 of top terminal 64. The use of cap 68 is not required to prevent water from contacting the terminals or conductors, but may be used to prevent inadvertent contact between nut 54 and conductive elements such as the under side of a battery box cover.

Figure 10:
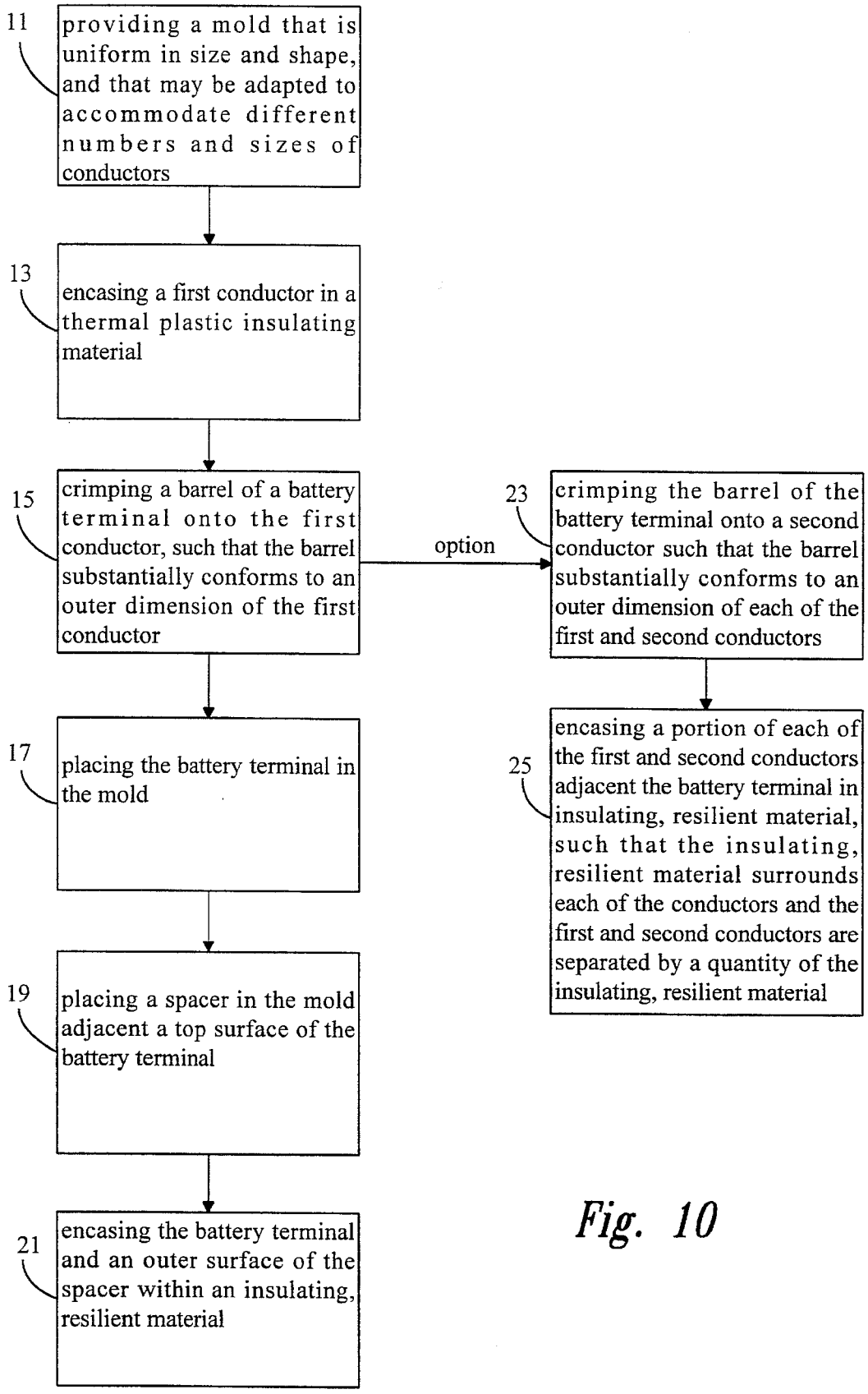
FIG. 10 is a diagram illustrating the steps of a preferred embodiment of the present invention.

Therefore, as illustrated in FIG. 10, a battery cable assembly 10 is provided in accordance with a preferred embodiment of the present invention by providing a mold that is uniform in size and shape, and that may be adapted to accommodate different numbers and sizes of conductors, step 11. A battery terminal having a tang and barrel is placed in the mold, step 17, the barrel of the terminal being crimped onto a conductor, such that the barrel substantially conforms to an outer dimension of the conductor, step 15. A conductive spacer is placed in the mold adjacent a top surface of the battery terminal such that the spacer is seated on the battery terminal, step 19, and an insulating, resilient material is injected into the mold, thereby encasing the battery terminal and an outer surface of the spacer, step 21. If it is desired to have more than one conductor coupled to the terminal, the barrel of the battery terminal is crimped onto a second conductor, such that the barrel substantially conforms to an outer dimension of each of the first and second conductors, step 23. To further ensure that the joint between the insulating, resilient material and the conductors is well sealed against moisture, a portion of the conductors adjacent the battery terminal is also encased in the insulating resilient material, such that the insulating, resilient material surrounds and separates the two conductors, step 25. To further ensure a secure seal, the conductors are encased in a thermal plastic insulating material that will bind to the insulating, resilient material, step 13.

A method and apparatus for providing a universal battery cable assembly has been shown and described. From the foregoing, it will be appreciated that, although embodiments of the invention have been described herein for purposes of illustration, modifications may be made without deviating from the spirit and scope of the invention. Thus, the present invention is not limited to the embodiments described herein, but rather is defined by the claims which follow.

We claim:

1. A battery cable assembly comprising:

a terminal having a tang coupled to a barrel, the tang being provided with an aperture to receive a stud of a battery, the barrel being adapted to receive a conductor; and a boot of insulating, resilient material encasing the terminal, a top surface of the boot being provided with a first annular opening having an inner wall and an annular bead protruding from the inner wall, a radially most inward surface of the annular bead being convex, the annular bead being adapted to sealingly engage a nut that may be provided on the stud of the battery to secure the terminal to the battery.

2. The battery cable assembly according to claim 1 wherein a bottom surface of the boot is provided with a second annular opening substantially aligned with the tang aperture and having a diameter that is greater than a diameter of the tang aperture, a wall of the second annular opening being dimensioned to sealingly engage an edge of a battery pad; and the first annular opening of the boot being surrounded by a raised member dimensioned to sealingly engage the second annular opening, such that a plurality of the boots may be stacked and sealingly engage one another.

3. The battery cable assembly according to claim 2 wherein a diameter of the first annular opening is greater than a diameter of the aperture in the tang, the first annular opening is substantially aligned with the aperture in the tang, and a spacer is provided in the first annular opening of the boot, such that if a second boot having the substantially same structure as the boot is positioned on top of the boot, the spacer will act as a conductive contact between the tang in the boot and a tang in the second boot.

4. A battery, cable assembly comprising:

a terminal having a tang coupled to a barrel, the tang being provided with an aperture to receive a stud of a battery, the barrel being adapted to receive a conductor;

a spacer having a hole that extends through a substantially central portion of the spacer and having an annular groove in an outer surface, the spacer being adjacent the tang, such that the hole of the spacer is substantially aligned with the aperture of the tang; and a boot of insulating, resilient material encasing the terminal and the outer surface of the spacer, such that when the spacer is removed, the boot is provided with a first annular opening having an inner wall and an annular bead protruding from the inner wall.

5. The battery cable assembly according to claim 4, further comprising:

a raised member surrounding the first annular opening of the boot;

a second annular opening provided in a bottom surface of the boot, the second annular opening being substantially aligned with the tang aperture and having a diameter that is greater than a diameter of the tang aperture; and the second annular opening being provided with a wall that is dimensioned to sealingly engage an edge of a battery pad and to sealingly engage the raised member, such that a plurality of boots may be stacked and sealingly engage one another, the boot acting as a bottom terminal if the spacer is left in the first annular opening, the boot acting as a top terminal if the spacer is removed from the first annular opening, and wherein a nut provided on the stud of the battery to secure a top terminal and a bottom terminal to the battery sealingly engages the annular bead of the top terminal.

6. The battery cable assembly according to claim 5, further comprising:

a cap made of insulating, resilient material that is adapted to fit over and sealingly engage the nut and the raised member of the top terminal.

7. The battery cable assembly according to claim 2 wherein an outer surface of the raised member is tapered along the full height of the raised member and the wall of the second annular opening is tapered thereby creating a tight interference fit and seal between the outer surface of the raised member and the wall of the second annular opening when two or more of the boots are stacked on one another.

8. The battery cable assembly according to claim 4 wherein the spacer has a radially outward annular surface that is concave, to sealingly receive the inwardly protruding convex surface of the annular bead.

9. A battery cable assembly comprising: a terminal having a tang coupled to a barrel, the tang being provided with an aperture to receive a stud of a battery, the barrel being adapted to receive a conductor; and a boot of insulating, resilient material encasing the terminal, a top surface of the boot being provided with a first annular opening having an inner wall and an annular bead protruding from the inner wall, the annular bead being adapted to sealingly engage a nut that may be provided on the stud of the battery to secure the terminal to the battery, a bottom surface of the boot being provided with a second annular opening substantially aligned with the tang aperture and having a diameter that is greater than a diameter of the tang aperture, a wall of the second annular opening being dimensioned to sealingly engage an edge of a battery pad, and the first annular opening of the boot being surrounded by a raised member dimensioned to sealingly engage the second annular opening, such that a plurality of the boots may be stacked and sealingly engage one another.

10. The battery cable assembly according to claim 9 wherein a diameter of the first annular opening is greater than a diameter of the aperture in the tang, the first annular opening is substantially aligned with the aperture in the tang, and a spacer is provided in the first annular opening of the boot, such that if a second boot having the substantially same structure as the boot is positioned on top of the boot, the spacer will act as a conductive contact between the tang in the boot and a tang in the second boot.

11. The battery cable assembly according to claim 9 wherein an outer surface of the raised member is tapered along the full height of the raised member and the wall of the second annular opening is tapered thereby creating a tight interference fit and seal between the outer surface of the raised member and the wall of the second annular opening when two or more of the boots are stacked on one another.

* * * * *